US008310439B2

(12) United States Patent
Lee et al.

(10) Patent No.: US 8,310,439 B2
(45) Date of Patent: Nov. 13, 2012

(54) APPARATUS AND METHOD FOR DRIVING AN ELECTROPHORETIC DISPLAY

(75) Inventors: Il-Pyung Lee, Suwon-si (KR); Cheol-Woo Park, Suwon-si (KR); Ho-Yong Jung, Yongin-si (KR)

(73) Assignee: Samsung Display Co., Ltd. (KR)

( * ) Notice: Subject to any disclaimer, the term of this patent is extended or adjusted under 35 U.S.C. 154(b) by 1043 days.

(21) Appl. No.: 12/043,695

(22) Filed: Mar. 6, 2008

(65) Prior Publication Data

US 2009/0046114 A1 Feb. 19, 2009

(30) Foreign Application Priority Data

Aug. 17, 2007 (KR) ..... 10-2007-0082586

(51) Int. Cl.
*G09G 3/34* (2006.01)

(52) U.S. Cl. ..... 345/107

(58) Field of Classification Search ..... 345/107, 345/441; 359/267

See application file for complete search history.

(56) References Cited

U.S. PATENT DOCUMENTS

| | | | | |
|---|---|---|---|---|
| 6,791,740 | B2 * | 9/2004 | Katase | 359/281 |
| 6,842,165 | B2 | 1/2005 | Inoue | |
| 2003/0217336 | A1 | 11/2003 | Gounares et al. | |
| 2006/0066503 | A1 | 3/2006 | Sampsell et al. | |
| 2006/0187185 | A1 | 8/2006 | Yoshinaga et al. | |
| 2007/0046609 | A1 * | 3/2007 | Lee | 345/94 |
| 2007/0205978 | A1 * | 9/2007 | Zhou et al. | 345/107 |
| 2007/0211061 | A1 * | 9/2007 | Kokojima | 345/441 |

FOREIGN PATENT DOCUMENTS

| | | |
|---|---|---|
| JP | 2004-029399 | 1/2004 |
| JP | 2004-101939 | 4/2004 |
| JP | 2004-102661 | 4/2004 |
| JP | 2005-025163 | 1/2005 |
| JP | 2005-189851 | 7/2005 |
| JP | 2006-023757 | 1/2006 |
| JP | 2006-113232 | 4/2006 |
| KR | 1020060096420 | 9/2006 |
| KR | 1020060133330 | 12/2006 |
| KR | 1020070019714 | 2/2007 |

* cited by examiner

*Primary Examiner* — Chanh Nguyen
*Assistant Examiner* — Jonathan Blancha
(74) *Attorney, Agent, or Firm* — Innovation Counsel LLP

(57) ABSTRACT

An apparatus for driving an electrophoretic display comprising a data driver applying data voltages to a plurality of pixels where electrophoretic particles are respectively disposed includes a memory storing gray information, level information of data voltages, and application time information of the data voltage, and a signal controller, wherein the signal controller reads the gray information, the level information of the data voltage and the application time information of the data voltage stored in the memory to apply an output image signal to the data driver, again stores the updated application time information of the data voltage to the memory by counting the application time information of the data voltage, compares the gray information stored in the memory with the gray information newly input from the external device, and when the gray information stored in the memory and the gray information newly input are different from each other, again stores the level information of the data voltage and the application time information of the data voltage that are newly updated in the memory based on the gray information that is newly input.

22 Claims, 9 Drawing Sheets

APPARATUS AND METHOD FOR DRIVING AN ELECTROPHORETIC DISPLAY

CROSS-REFERENCE TO RELATED APPLICATION

This application claims priority under 35 U.S.C. §119 to Korean Patent Application No. 10-2007-0082586 filed in the Korean Intellectual Property Office on Aug. 17, 2007, the entire contents of which are incorporated herein by reference.

BACKGROUND OF THE INVENTION (a) Field of the Invention

The present disclosure relates to an apparatus and method for driving an electrophoretic display.

(b) Description of the Related Art

Recently, an electrophoretic display (EPD) and a liquid crystal display (LCD) have been actively developed as flat panel display device types.

The electrophoretic display includes a pixel having a switching element connected to an electrophoretic capacitor, an electrophoretic display panel assembly including a display signal line, a gate driver turning on/off the switching element of the pixel by outputting scanning signals of a gate-on voltage and a gate-off voltage to a gate line of the display signal line, a data driver applying data voltages to a pixel electrode through the switching element, which is turned on by outputting data voltages to a data line of the display signal line, and a signal controller controlling the gate driver and the data driver.

The electrophoretic capacitor includes two terminals. The first terminal is formed by the pixel electrode of the electrophoretic display panel assembly and the second terminal is formed by a common electrode. An electrophoretic layer including electrophoretic particles dispersed in a dielectric fluid are positioned between the two electrodes as a dielectric material. The common electrode receives a common voltage as a reference voltage, and the pixel electrode receives data voltages based on gray information such that the image display voltage corresponding to the difference between two voltages is applied with the electrophoretic particles. The electrophoretic particles, charged with a positive or negative polarity, are then moved between the two electrodes. The moving distance of the electrophoretic particles is controlled by the application of the image display voltage. In other words, the image display voltage is controlled by the level and the application time of the data voltage based on the gray information. As indicated above, if the level and the application time of the data voltage based on the gray information are controlled in each pixel, the electrophoretic particles are located at various positions between the pixel electrode and the common electrode to display the images with various grays.

Information disclosed in the Background section is only for enhancement of understanding the background of the invention.

SUMMARY OF THE INVENTION

The electrophoretic display has a slow image display speed compared with other flat display devices. As the data voltage is updated upon receiving gray information that is updated from external information received from an input device in real time, it cannot immediately be applied to each pixel and is therefore more difficult to improve the speed of the image display.

Accordingly, an object according to the one embodiment is to provide an apparatus and method for driving an electrophoretic display to improve the speed of the image display by rapidly displaying the desired images through the immediate application of the necessary data voltage to each pixel by updating the gray information for each pixel.

An apparatus for driving the electrophoretic display according to an embodiment comprises a data driver applying data voltages to a plurality of pixels where electrophoretic particles are respectively disposed; a memory storing gray information, level information of data voltages, application time information of the data voltage; and a signal controller. The signal controller reads the gray information, the level information of the data voltage, and the application time information of the data voltage stored in the memory to apply an output image signal to the data driver. The apparatus again stores the updated application time information of the data voltage to the memory by counting the application time information of the data voltage, compares the gray information stored in the memory with the gray information newly input from the external device, and when the two gray information stored in the memory and the gray information newly input are different from each other, again stores the level information of the data voltage and the application time information of the data voltage that are newly updated to the memory based on the gray information that is newly input.

The memory may include a first memory storing the gray information, a second memory storing the level information of the data voltage, and a third memory storing the application time information of the data voltage.

The signal controller may read the gray information, the level information of the data voltage, and the application time information of the data voltage stored in the first memory, the second memory, and the third memory to apply the output image signal to the data driver. The signal controller may store the updated application time information of the data voltage to the third memory by counting the application time information of the data voltage. The signal controller may compare the gray information stored in the first memory with the gray information that is newly input from the external device. When the gray information stored in the first memory and the gray information newly input are different from each other the signal controller may again store the level information of the data voltage and the application time information of the data voltage as the updated level information of the data voltage and the updated application time information of the data voltage to the second memory and the third memory to amend the luminance currently displayed by the pixel into the luminance to display by the gray information that is newly input based on the gray information stored in the first memory.

The signal controller may compare the gray information stored in a first memory with the newly updated gray information when the gray information stored in the first memory and the gray information newly input are the same. The signal controller ignores the new input gray information and drives the data driver based on the gray information, the level information of the data voltage, and the application time information of the data voltage respectively stored in the first memory, the second memory, and the third memory.

The signal controller further may include a counter performing counting to update the application time information of the data voltage stored in the third memory as a predetermined time unit.

The counting may be performed per 1 frame.

The data voltage may be applied during 1 horizontal period per the 1 frame, and the application time information of the data voltage updated through the counting may be the application time information that is generated by subtracting 1 horizontal period from the application time of the data voltage before performing the counting.

The counting may be performed by the synchronization of a data enable signal. While the comparison of the gray information stored in the first memory with the newly input gray information from the external device may be performed by the synchronization of a horizontal synchronizing signal.

The signal controller may output an output image compensation signal to the data driver based on the gray information, the level information of the data voltage, and the application time information of the data voltage stored in the memory when the application time information of the data voltage stored in the memory is completely updated.

The storage space of the memory may correspond one to one to the pixel.

The memory may further include a fourth memory storing position information of each pixel to which the data voltage is applied.

A method for driving an electrophoretic display including a data driver for applying data voltages to a plurality of pixels to which electrophoretic particles are respectively provided according to an exemplary embodiment includes storing gray information, level information of the data voltage, and application time information of the data voltage to a memory; outputting an output image signal to the data driver according to the gray information, the level information of the data voltage, and the application time information of the data voltage stored in the memory; and again storing the updated application time information of the data voltage by counting the application time information of the data voltage to the memory, and comparing the gray information stored in the memory with the gray information newly input from an external device if the new gray information is input from the external device. Again storing the newly updated level information of the data voltage and the newly updated application time information of the data voltage to the memory according to the newly input gray information when the gray information stored in the memory and the gray information newly input are different from each other; or ignoring the newly input gray information and driving the data driver according to the gray information, the level information of the data voltage, and the application time information of the data voltage stored in the memory when the gray information stored in the memory and the gray information newly input are the same.

The memory may include a first memory storing the gray information, a second memory storing the level information of the data voltage, and a third memory storing the application time information of the data voltage.

The step of again storing the updated application time information by counting the application time information of the data voltage, and outputting the output image signal to the data driver according to the gray information, the level information of the data voltage and the application time information of the data voltage stored in the memory may include reading the gray information, the level information of the data voltage, and the application time information of the data voltage respectively stored in the first memory, the second memory, and the third memory to output the output image signal to the data driver, and again storing the updated application time information of the data voltage to the third memory by counting the application time information of the data voltage.

The step of comparing the gray information stored in the memory with the gray information newly input from the external device if the new gray information is input from the external device, and again storing the level information of the data voltage and the application time information of the data voltage that are newly updated to the memory according to the newly input gray information when the gray information stored in the memory and the gray information newly input are different from each other may include comparing the gray information stored in the first memory with the newly input gray information from the external device, when the gray information stored in the first memory and the gray information newly input are different from each other, and again storing the level information and the application time information of the data voltage into the level information of the data voltage and the application time information of the data voltage that are newly updated to the second memory and the third memory to amend the luminance displayed in the pixel according to the gray information stored in the first memory into the luminance to newly display in the pixel according to the newly input gray information.

When the level information of the data voltage and the application time information of the data voltage that are newly updated are again stored in the second memory and the third memory, the method may further include outputting the output image signal to the data driver according to the gray information, the level information of the data voltage, and the application time information of the data voltage again stored in the first memory, the second memory, and the third memory, and again storing the application time information updated through the counting to the third memory.

The method may further include applying an output image compensation signal to the data driver when the application time information of the data voltage stored in the memory is completely updated through the counting.

The counting may be performed per 1 frame.

The data voltage may be applied during 1 horizontal period per the 1 frame, and the application time information of the data voltage updated through the counting may be the application time information generated by subtracting 1 horizontal period from the application time of the data voltage before performing the counting.

The counting may be performed by the synchronization of a data enable signal, and the comparison of the gray information stored in the first memory with the gray information that is newly input from the external device may be performed by the synchronization of a horizontal synchronizing signal.

The method may further include outputting an output image compensation signal to the data driver based on the gray information, the level information of the data voltage, and the application time information of the data voltage stored in the memory when the application time information of the data voltage stored in the memory is completely updated.

The memory may further include a fourth memory storing position information of each pixel to which the data voltage is applied.

DETAILED DESCRIPTION OF THE EMBODIMENTS

The present invention will be described more fully hereinafter with reference to the accompanying drawings, in which exemplary embodiments are shown.

First, an electrophoretic display according to an exemplary embodiment will be described with reference to FIG. 1 to FIG. 4.

Figure 1:
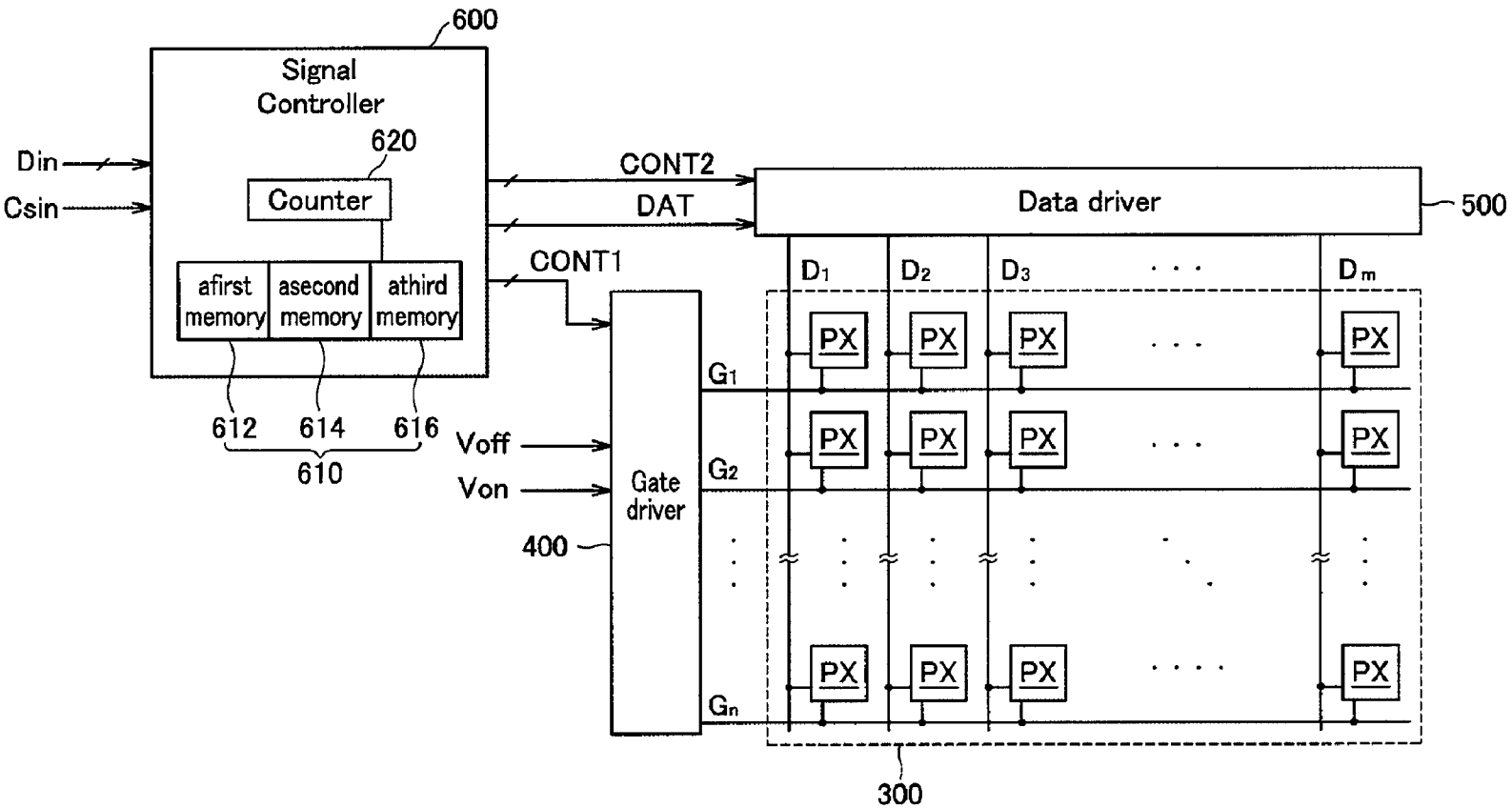
FIG. 1 is a block diagram of an electrophoretic display according to an exemplary embodiment.
Figure 2:
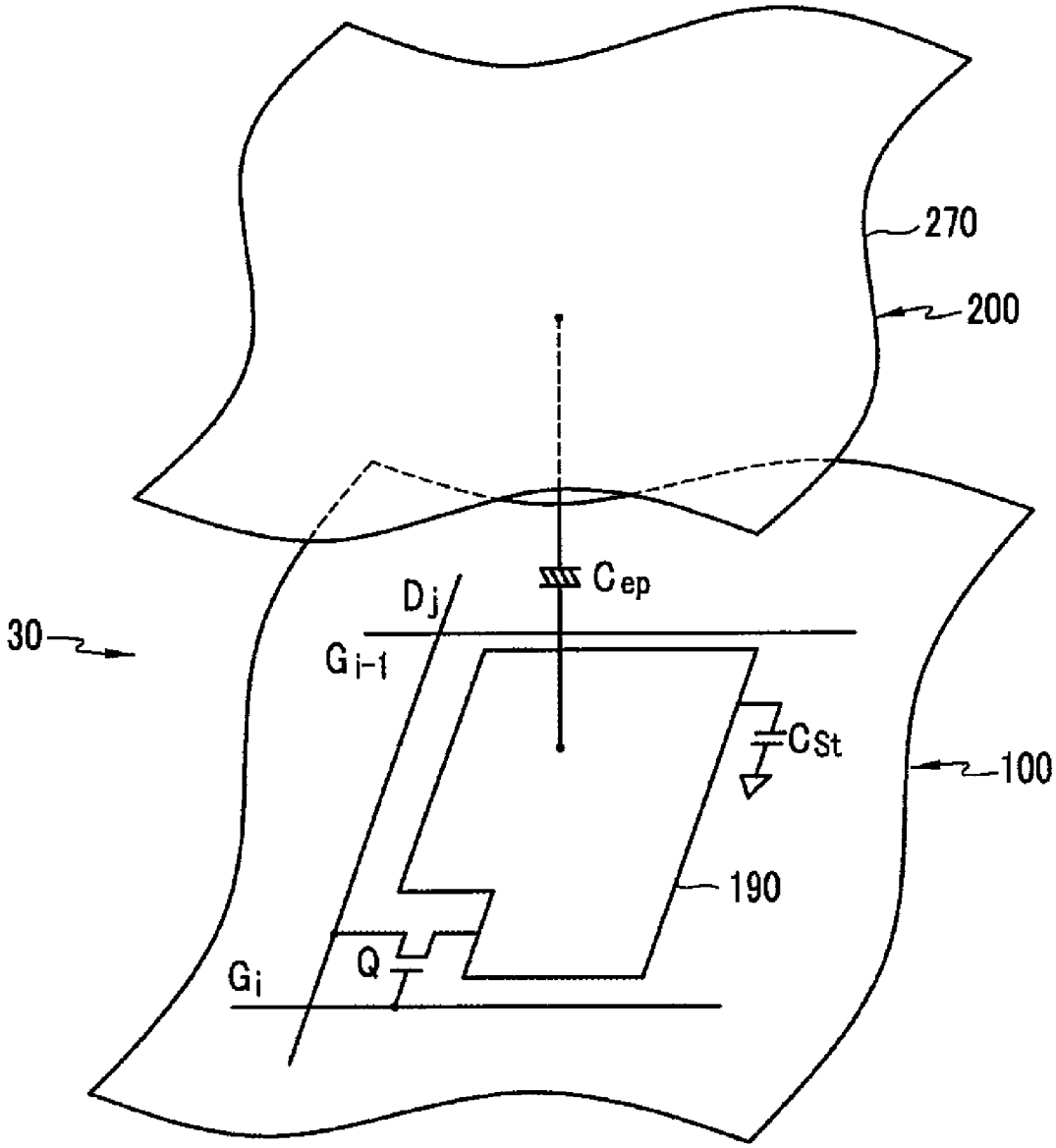
FIG. 2 is an equivalent circuit diagram of one pixel of an electrophoretic display according to an exemplary embodiment.
Figure 3:
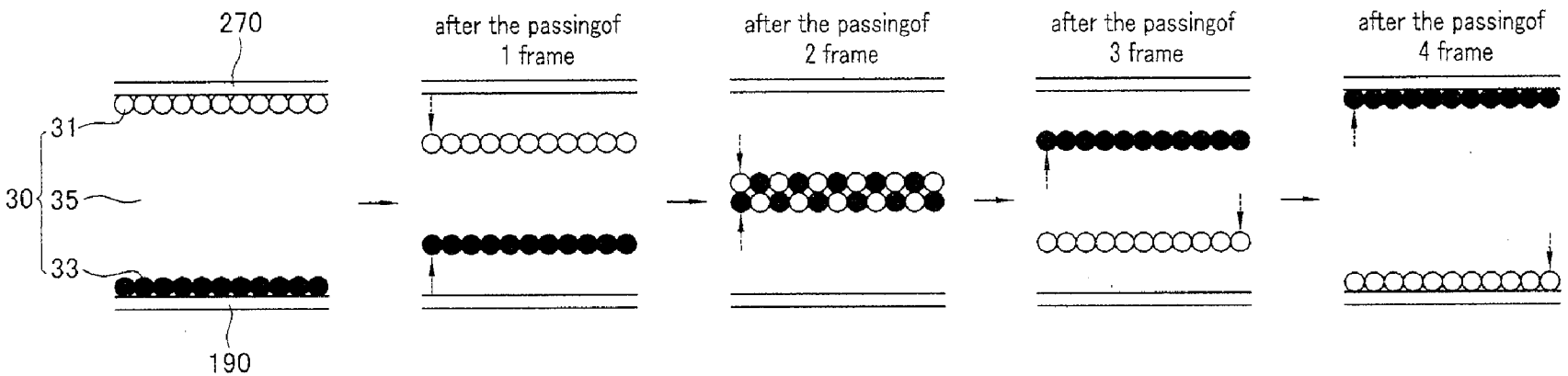
FIG. 3 is a view for explaining different arrangements of the electrophoretic particles positioned in a predetermined pixel of the electrophoretic display according to an exemplary embodiment.
Figure 4:
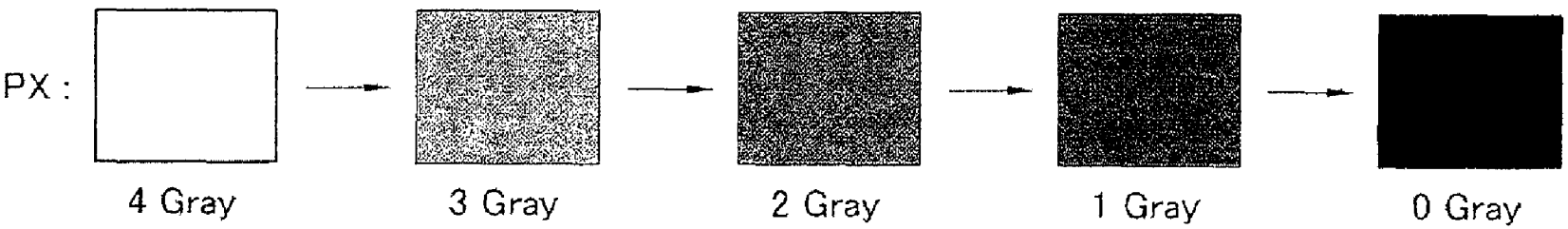
FIG. 4 is view showing the gray respectively displaying in the predetermined pixel according to the different arrangements of the electrophoretic particles shown in FIG. 3.

FIG. 1 is a block diagram of an electrophoretic display according to an exemplary embodiment, FIG. 2 is an equivalent circuit diagram of one pixel of an electrophoretic display according to an exemplary embodiment, FIG. 3 is a view for explaining different arrangements of the electrophoretic particles positioned in a predetermined pixel of the electrophoretic display according to an exemplary embodiment, and FIG. 4 is view showing the gray respectively displaying in the predetermined pixel according to the different arrangements of the electrophoretic particles shown in FIG. 3.

As shown in FIG. 1, the electrophoretic display according to the present embodiment includes an electrophoretic panel assembly 300, a gate driver 400, a data driver 500, and a signal controller 600.

As shown in the equivalent circuit of FIG. 1 and FIG. 2, the electrophoretic display panel assembly 300 includes a plurality of display signal lines G1 to Gn and D1 to Dm, and a plurality of pixels PX arranged basically in a matrix form and connected thereto. Further, as shown in FIG. 3, each pixel of the electrophoretic display panel assembly 300 includes a pixel electrode 190 and a common electrode 270 facing each other and an electrophoretic layer 30 interposed therebetween.

The signal lines G1 to Gn and D1 to Dm include a plurality of gate lines G1-Gn for transmitting gate signals (or referred to as "scanning signals") and a plurality of data lines D1-Dm for transmitting data voltages. The gate lines G1-Gn are arranged in the row direction and in parallel, and the data lines D1-Dm are arranged in the column direction and in parallel.

As shown in FIG. 2, a pixel, for example a pixel PX coupled to the i-th (i=1, 2, . . . , n) gate line Gi and the j-th (j=1, 2, . . . , m) data line Dj, includes a switching element Q coupled to the signal lines Gi and Dj, an electrophoretic capacitor Cep coupled thereto, and a storage capacitor Cst. The storage capacitor Cst may be omitted if necessary.

The switching element Q may be a three terminal element such as a thin film transistor provided in a lower panel 100, and includes a control terminal connected to the gate line Gi, an input terminal connected to the data line Dj, and an output terminal connected to the electrophoretic capacitor Cep and the storage capacitor Cst.

The electrophoretic capacitor Cep includes two terminals, the pixel electrode 190 disposed on the lower panel 100, and the common electrode 270 disposed on an upper panel 200. The electrophoretic layer 30 disposed between the two electrodes 190 and 270 functions as a dielectric material of the electrophoretic capacitor Cep. The pixel electrode 190 is connected to the switching element Q, and the common electrode 270 is supplied with a common voltage Vcom and covers an entire surface of the upper panel 200.

The electrophoretic layer 30 includes white electrophoretic particles 31 charged with negative charges (−) or positive charges (+), black electrophoretic particles 33 charged with the opposite polarity to that of the white electrophoretic particles 31, and a transparent dielectric fluid 35. The electrophoretic layer 30 may further include microcapsules for confining the electrophoretic particles 31 and 33 and the transparent dielectric fluid 35.

The storage capacitor Cst is an auxiliary capacitor for the electrophoretic capacitor Cep. The storage capacitor Cst includes the pixel electrode 190 and a separate signal line, which is provided on the lower panel 100, overlaps the pixel electrode 190 via an insulator, and is supplied with a predetermined voltage such as the common voltage Vcom. Alternatively, the storage capacitor Cst includes the pixel electrode 190 and an adjacent gate line called a previous gate line G(i−1), which overlaps the pixel electrode 190 via an insulator. The storage capacitor Cst may be omitted if necessary.

The gate driver 400 is connected to the gate lines G1-Gn and synthesizes a gate-on voltage Von and a gate-off voltage Voff to generate the gate signals for application to the gate lines G1-Gn.

The data driver 500 is connected to the data lines D1-Dm of the electrophoretic display panel assembly 300, and applies data signals corresponding to image data signals to the data lines D1-Dm.

The signal controller 600 controls the gate driver 400 and the data driver 500, etc., and includes a memory unit 610 and a counter 620.

The memory unit 610 includes a first memory 612, a second memory 614, and a third memory 616, as additional memory. The first memory 612, the second memory 614, and the third memory 616 may be realized as separate devices, and can be different storage spaces installed in a single storage device.

The first memory 612 stores gray information as luminance information for displaying each pixel PX, which is an input image signal Din inputted from an external graphics controller (not shown) or external input device (not shown). The second memory 614 stores level information of the data voltage applied to each pixel based on the gray information stored in the first memory 612. The level information of the data voltage includes positive level information larger than the common voltage and negative level information smaller than the common voltage as relative magnitude information of the data voltage to the common voltage for changing the positions of the electrophoretic particles 31 and 33.

Also, the third memory 616 stores application time information of the data voltage applied to each pixel PX based on the gray information stored in the first memory 612. The application time information of the data voltage is the time the data voltage of a predetermined level is applied to electrophoretic particles 31 and 33 for changing the positions of the electrophoretic particles 31 and 33. The time for applying the data voltage corresponds to 1 horizontal period for each frame in the driving process of the electrophoretic display. The application time information of the data voltage is information regarding an application time of the data voltage based on the previous stored gray information or the new gray information from an external device, or the information regarding the application time of the data voltage that is updated through the counting.

The counter 620 performs counting for balancing the application time data voltage for each frame to update the total application time information of the data voltage stored in the third memory 616 or previous updated application time information. The application time information of the data voltage, restored in the third memory 616 and updated through the counting, is the information that the application time of the data voltage is reduced by 1 horizontal period before performing the counting.

The signal controller 600 reads the gray information, the level information, and the application time information of the data voltages stored in the first memory 612, the second memory 614, and the third memory 616 to output an output image signal DAT to the data driver 500, and again stores the newly updated application time information of the data voltage in the third memory 616 by counting the application time information of the data voltage. The signal controller 600 compares the gray information stored in the first memory 612 with the new gray information input from the external device. When the stored gray information and the input gray information are different, the signal controller 600 restores the level information and the application time information of the necessary data voltage required to amend the luminance displaying the pixel PX based on the gray information stored in the first memory 612 into the luminance newly displaying the pixel PX based on the newly input gray information in the second memory 614 and the third memory 616 as the level information and the application time information of the data voltage that are newly updated, respectively.

Also, when the stored gray information and the input gray information are the same, the gray information that is newly input is ignored, and the signal controller 600 keeps on driving the data driver 500 based on the gray information, the level information of the data voltage, and the application time information of the data voltage stored in the first memory 612, the second memory 614, and the third memory 616.

An image display operation by the electrophoretic display will now be described in detail.

The signal controller 600 receives, in real-time, an input image signal (Din) and an input control signal (CSin) for controlling display of the input image signal from an external graphics controller (not shown) or an external input device (not shown). Examples of the input control signal are a vertical synchronization signal, a horizontal synchronizing signal, a main clock signal, a data enable signal, etc.

The signal controller 600 processes the input image signal (Din) according to the operating condition of the electrophoretic panel assembly 300 based on the input image signal (Din) and the input control signal (CSin), generates a gate control signal CONT1 and a data control signal CONT2, outputs the gate control signal CONT1 to the gate driver 400, and outputs the data control signal CONT2 and the processed output image signal DAT to the data driver 500.

The gate control signal CONT1 includes a scanning start signal STV for instructing the scanning signal's scan start and at least one clock signal CLK for controlling the scanning signal's output. The gate control signal CONT1 can further include an output enable signal OE for controlling the maintenance time of the gate on voltage Von.

The data control signal CONT2 includes a horizontal synchronization start signal STH for indicating data transmission of one pixel row, a load signal LOAD for loading the corresponding data voltage to the data lines D1-Dm, and a data clock signal HCLK.

The data driver 500 receives an output image signal DAT on the pixels PX of one row based on the data control signal CONT2 provided by the signal controller 600, converts the output image signal DAT into the corresponding data voltage, and applies the data voltage to the corresponding data lines D1-Dm.

The gate driver 400 applies the scanning signal to the gate lines G1-Gn based on the gate control signal CONT1 provided by the signal controller 600 to turn on the switch Q coupled to the gate lines ($G_1$-$G_n$), and hence the data voltage applied to the data lines D1-Dm is applied to the corresponding pixel PX through the turned on switch Q.

The difference between the data voltage applied to the pixel PX and the common voltage Vcom is indicated by a charging voltage of the electrophoretic capacitor (Cep), that is, the pixel voltage. The level of the pixel voltage and the application time of the pixel voltage are determined based on the level of the pixel voltage and the application time of the data voltage for the common voltage. By repeating this procedure by a unit of the horizontal period (which is denoted by "1H" and is equal to one period of the horizontal synchronization signal Hsync and the data enable signal DE), all gate lines G1-Gn are sequentially supplied with the gate-on voltage Von, thereby applying the data signals with the predetermined level to all pixels to display an image of one frame.

Generally, the white electrophoretic particles 31 and the black electrophoretic particles 33 positioned at the common electrode 270 and the pixel electrode 190 of a predetermined pixel PX move between the pixel electrode 190 and the common electrode 270 when a predetermined data voltage is applied during 1 horizontal period of one frame. A predetermined data voltage is applied during the 1 horizontal period of a plurality of frames in order for the white electrophoretic particles 31 and the black electrophoretic particles 33 to completely move between the pixel electrode 190 and the common electrode 270.

In an exemplary embodiment, during the total horizontal period of 4 frames the electrophoretic particles 31 and 33 are disposed with different arrangements, that is, the five different grays from 0 gray to 4 gray are displayed. In this regard, as shown in leftmost picture of FIG. 3, when the white electrophoretic particles 31 and the black electrophoretic particles 33 respectively move and are disposed close to the common electrode 270 and the pixel electrode 190, the corresponding pixel PX displays the image of 4 gray corresponding to a white color, as shown in FIG. 4. In contrast, as shown in the rightmost picture of FIG. 3, after the 4 frames, when the white electrophoretic particles 31 and the black electrophoretic particle 33 respectively move and are disposed close to the pixel electrode 190 and the common electrode 270, the corresponding pixel PX displays the image of 0 gray corresponding to a black color, as shown in FIG. 4.

Furthermore, when the white and black electrophoretic particles 31 and 33 are respectively disposed at different positions for each frame between the pixel electrode 190 and the common electrode 270, as respectively shown from the second to fourth pictures of FIG. 3, the corresponding pixel PX may display the images respectively corresponding to 3 gray, 2 gray, and 1 gray, which are the middle grays between the white color and the black color, and have gradually decreasing luminance, as shown in FIG. 4.

On the other hand, data voltage levels or the application time of the data voltages may be controlled for the electrophoretic particles 31 and 33 to have greater or fewer than 5 different arrangements. Accordingly, the corresponding pixel PX may display an image with various grays such as 4 grays, 16 grays, or 32 grays.

A method for driving an electrophoretic display according to an exemplary embodiment will be described with reference to FIG. 1 to FIG. 8.

Figure 5:
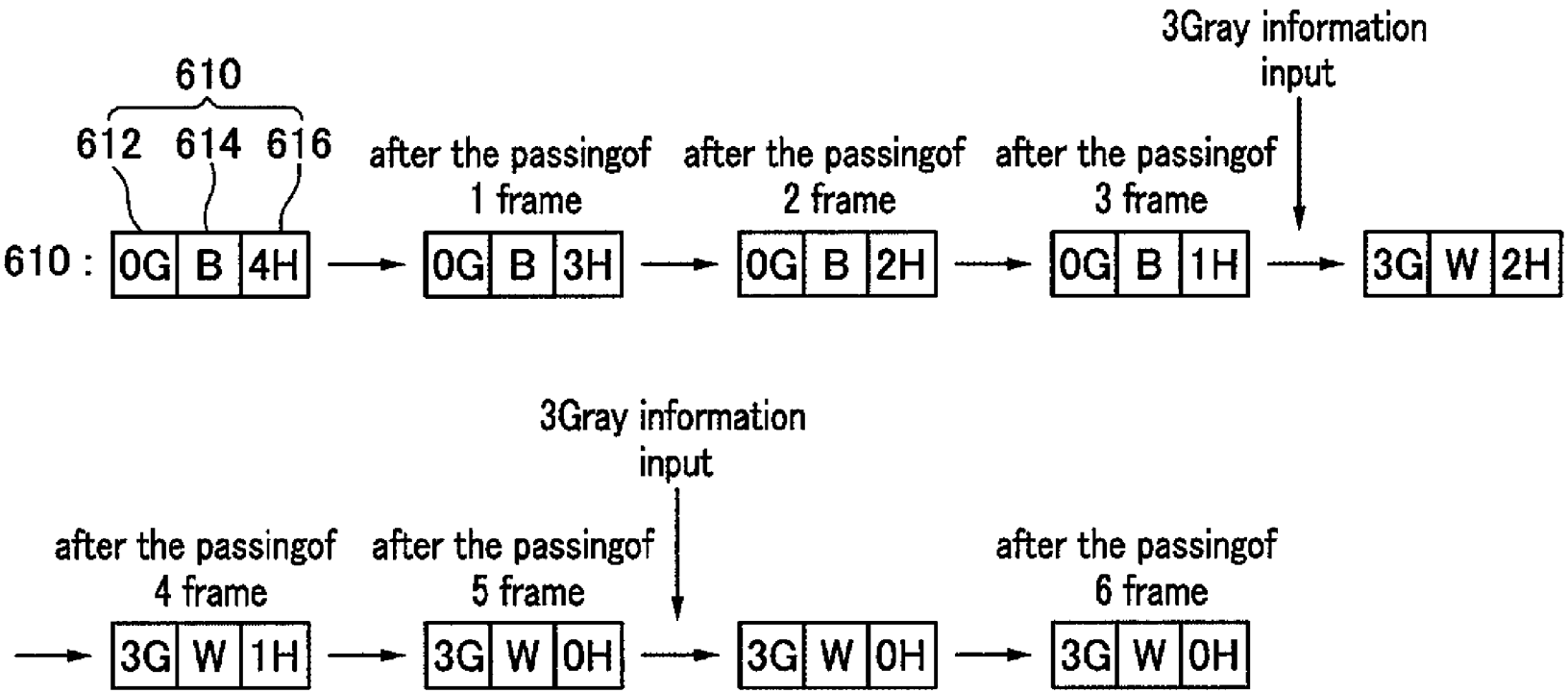
FIG. 5 is a view explaining an update process according to level information and application time information of data voltages applied to the pixel, and gray information of the pixel stored per frame in a memory of a driving device of the electrophoretic display according to an exemplary embodiment.
Figure 6:
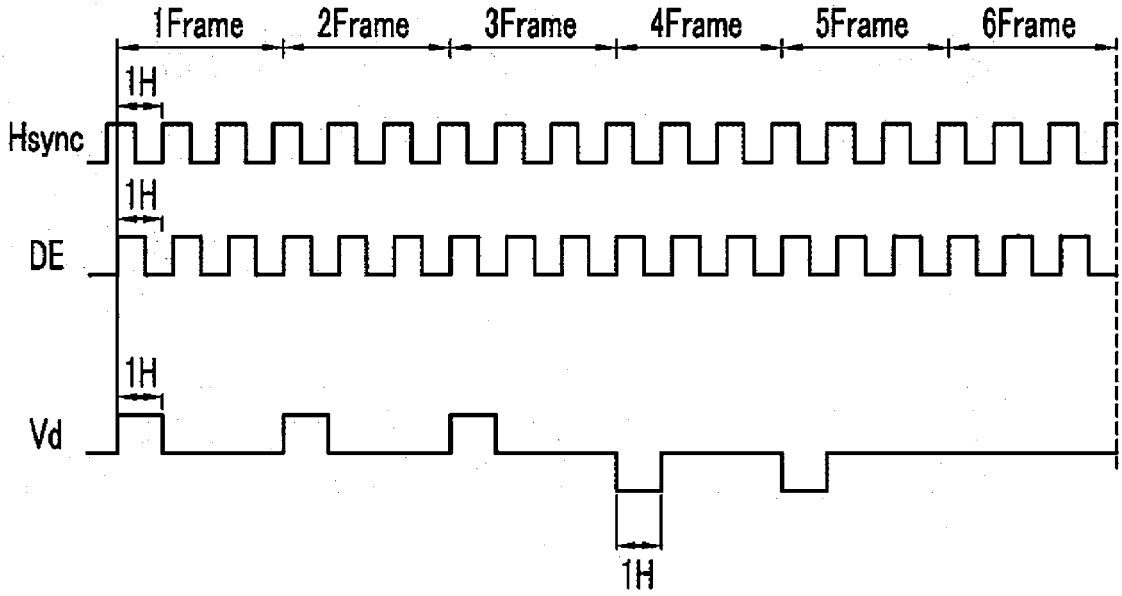
FIG. 6 is a view showing the data voltages applied to the pixel through a data driver according to the level information and the application time information of data voltages, and the gray information stored in a memory shown in FIG. 5.
Figure 7:
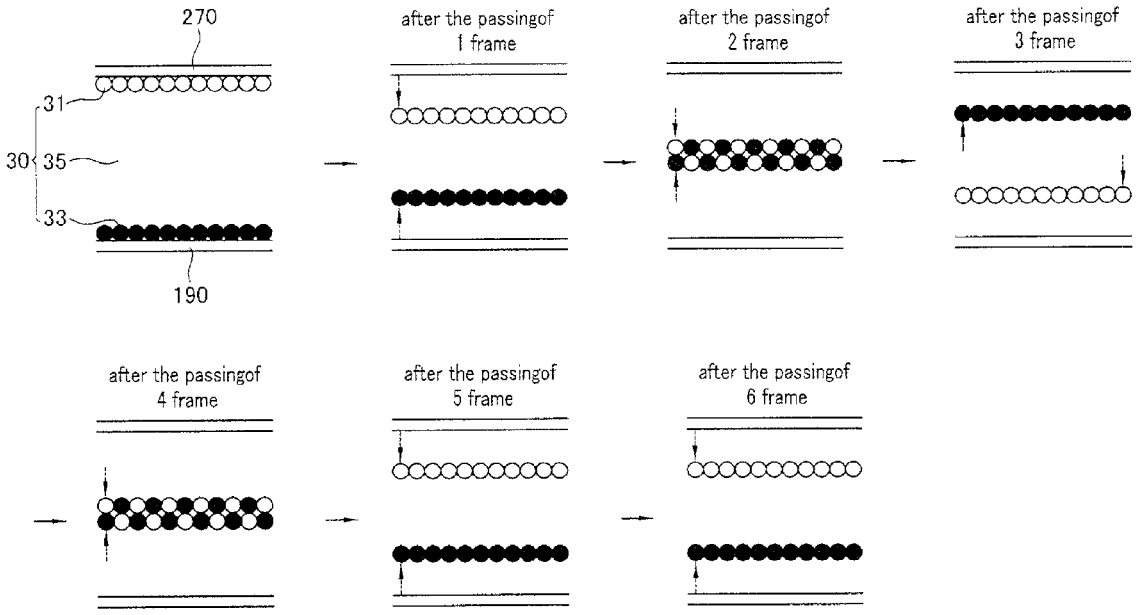
FIG. 7 is a view showing a location change of the electrophoretic particles located in the predetermined pixel in each frame unit according to the application of the data voltages shown in FIG. 6.
Figure 8:
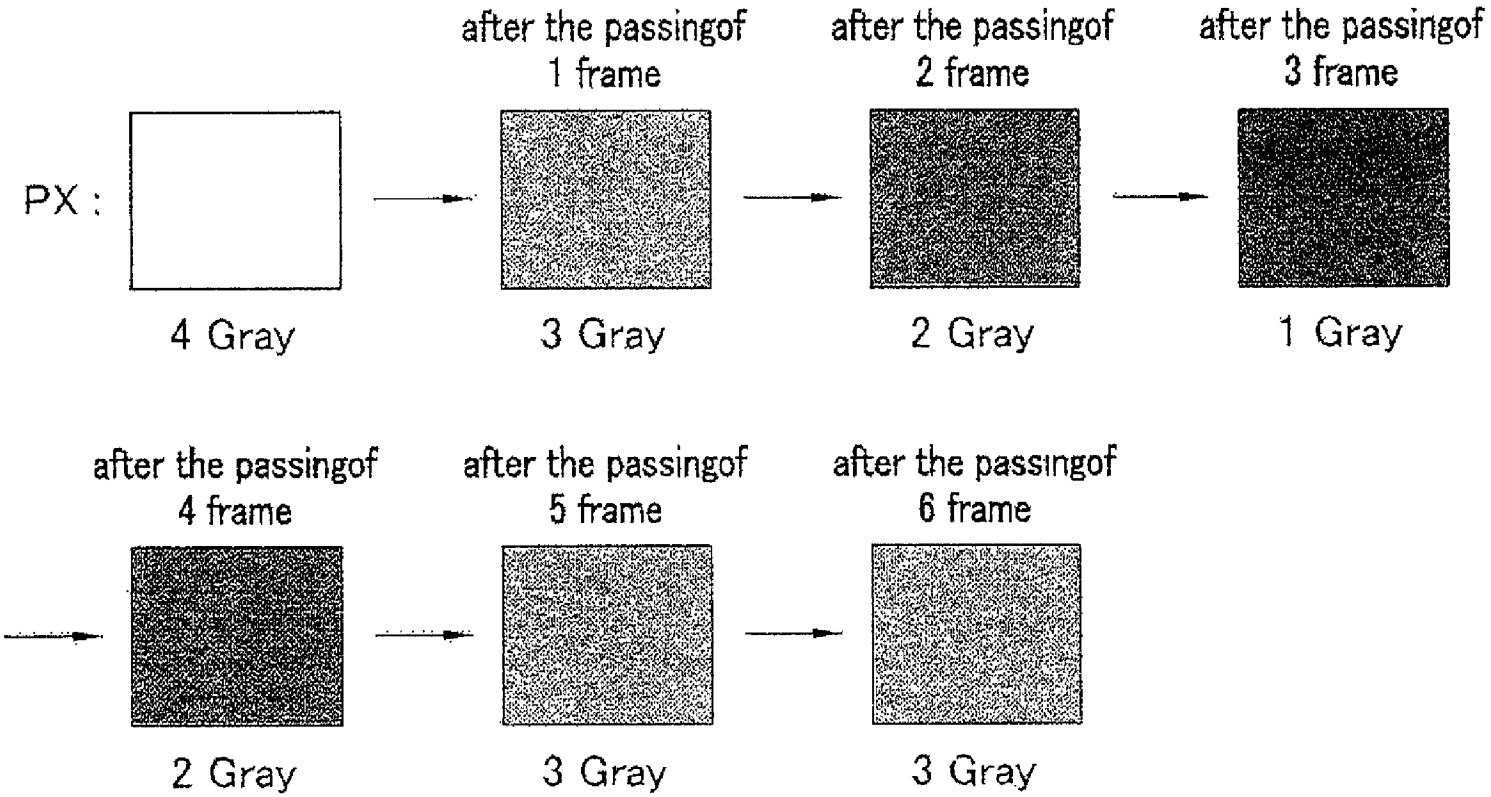
FIG. 8 shows a gray of the predetermined pixel in each frame unit according to the arrangement of the electrophoretic particles located in the predetermined pixel by the application of the data voltage of FIG. 6.

FIG. 5 is a view explaining an update process according to level information and application time information of data voltages applied to the pixel, and gray information of the pixel stored per frame in a memory of a driving device of the electrophoretic display according to an exemplary embodiment. FIG. 6 is a view showing the data voltages applied to the pixel through a data driver according to the level information and the application time information of data voltages, and the gray information stored in a memory shown in FIG. 5, FIG. 7 is a view showing a location change of the electrophoretic particles located in the predetermined pixel in each frame unit according to the application of the data voltages shown in FIG. 6, and FIG. 8 is a gray of the predetermined pixel in each frame unit according to the arrangement of the electrophoretic particles located in the predetermined pixel by the application of the data voltage of FIG. 6.

It is assumed that the white electrophoretic particles 31 are charged with the negative charges (−), and the black electrophoretic particles 33 are charged with the positive charges (+). Also, the operation for displaying the images with the various grays will be explained with reference to one arbitrary pixel of a plurality of pixels provided in the electrophoretic display. Further, the common voltage as the reference voltage used in one embodiment is a ground voltage, and the data voltage is a positive level voltage or a negative level voltage having the same magnitude, however, if a difference between the common voltage and the data voltage is satisfied, the data voltage may be two voltages having the same polarity and a different magnitude.

When the signal controller 600 applies a reset image signal to the data driver 500 based on an input image signal Din and an input control signal CSin from the outside, the data driver 500 applies a data voltage with a positive level to all the pixels PX. Here, the application time of the data voltage with a positive level is 1 horizontal period per frame during the 4 frames. Therefore, the application time of the data voltage with a positive level is 4 horizontal periods. Accordingly, the white electrophoretic particles 31 move so as to be arranged at the pixel electrode 190, and the black electrophoretic particles 33 move so as to be arranged at the common electrode 270 (which corresponds to the arranged state after the 4 frames are passed as shown in FIG. 4). Therefore, all the pixels PX display the black that is the 0 gray images after the 4 frames of FIG. 4.

When the signal controller 600 applies a reset image compensation signal to the data driver 500 based on an input image signal Din and an input control signal CSin from the outside, the data driver 500 applies a data voltage with a negative level to all the pixels PX. Here, the application time of the data voltage with a positive level is also 1 horizontal period per 1 frame during the 4 frames such that the application time of the data voltage with a positive level is 4 horizontal periods during the 4 frames. Accordingly, as shown in the leftmost picture of FIG. 7, the white electrophoretic particles 31 disposed on the pixel electrode 190 move to the common electrode 270, and the black electrophoretic particles 33 arranged on the common electrode 270 move to the pixel electrode 190. Therefore, all the pixels PX display the white which is the 4 gray image, as shown in the leftmost picture of FIG. 8.

The application of the data voltage with a positive level by applying a reset image signal and the application of the data voltage with a negative level by applying a reset image compensation signal store no charges in both the electrodes 190 and 270. Also, because all the pixels PX display the 4 gray image as white, the data voltage with the predetermined level is applied during the predetermined time such that the images with the different gray levels are displayable.

Next, the signal controller 600 applies an output image display signal that is updated in real-time per 1 horizontal period based on an input image signal Din and an input control signal CSin from the outside to the data driver 500 for each frame, which will now be described in detail.

First, the signal controller 600 receives gray information for displaying the image with the 0 gray corresponding to the luminance of a black color to the predetermined pixel PX from an external graphics controller (not shown) or an external input (not shown) and stores the gray information into the first memory 612 of the memory unit 610, and the level information of the data voltage and the application time information of the data voltage that are applied to the predetermined pixel PX to the second memory 614 and the third memory 616, respectively.

As shown in FIG. 5, the signal controller 600 stores 0 gray information 0G, the level information B of the positive data voltage, and 4 horizontal period time information 4H as the application time information to the corresponding storage spaces of the first memory 612, the second memory 614, and the third memory 616 corresponding to the predetermined pixel PX.

Next, the signal controller 600 reads the gray information, the level information of the data voltage, and the application time information of the data voltage that are stored in the first memory 612, the second memory 614, and the third memory 616.

The storage space of the first memory 612 stores the 0 gray information 0G, and the storage spaces of the second memory 614 and the third memory 616 respectively store the level information B with the positive data voltage and the 4 horizontal period time information as the application time information. Accordingly, the signal controller 600 applies an output image signal DAT to the data driver 500 so that the data driver 500 applies a data voltage Vd with a positive level to the corresponding pixel PX during 1 horizontal period of the first frame, as shown in FIG. 6. Also, the signal controller 600 subtracts the 1 horizontal period from the 4 horizontal periods that is application time information of the data voltage through the counting of the counter 620 performed by the synchronization of the data enable signal DE, and again stores the 3 horizontal period time information 3H that is application time information that is updated to the corresponding storage space of the third memory 616.

Because data pixel voltage with a positive level is applied during the 1 horizontal period of the first frame the electrophoretic particles 31 and 33 disposed in the corresponding pixel PX move to the position of FIG. 7 after passing the first frame. Accordingly, the corresponding pixel PX displays the image corresponding to 3 gray, as shown in FIG. 8.

After the passing the first frame and before the start of the second frame, the signal controller 600 again reads the gray information, the level information of the data voltage, and the updated application time information of the data voltage, which are stored in the first memory 612, the second memory 614, and the third memory 616. The 0 gray information 0G that is the same as the previous frame and the level information B of the positive data voltage are respectively stored in the corresponding storage spaces of the first memory 612 and the second memory 614, and the 3 horizontal period time information 3H that is application time information of the data voltage that is updated through the counting is stored in the corresponding storage space of the third memory 616. Accordingly, the signal controller 600 applies an output image signal DAT to the data driver 500 so that the data driver 500 may apply a data voltage Vd with a positive level to the corresponding pixel PX during the 1 horizontal period of the second frame, as shown in FIG. 6. In this instance, the signal controller 600 again stores the 2 horizontal period time information 2H that is application time information of the data voltage that is newly updated and is generated by subtracting the 1 horizontal period from the 3 horizontal periods that is previously updated as application time information of the data voltage through the counting of the counter 620 in the corresponding storage space of the third memory 616. The electrophoretic particles 31 and 33 disposed in the corresponding pixel PX move as shown in the picture after the passing of the second frame of FIG. 7 because of application of the data voltage with a positive level during the 1 horizontal period of the second frame such that the corresponding pixel PX displays the image that corresponds to the second gray, as shown in FIG. 8.

After passing the second frame and before the start of the third frame, the signal controller 600 again reads the gray information, the level information of the data voltage, and the updated application time information of the data voltage, which are respectively stored in the first memory 612, the second memory 614, and the third memory 616. The 0 gray information 0G that is the same as the previous frame and the level information B of the positive data voltage are respectively stored in the corresponding storage spaces of the first memory 612 and the second memory 614, and the 2 horizontal period time information 2H that is application time information of the data voltage that is updated is stored in the third memory 616. Accordingly, the signal controller 600 applies an output image signal DAT to the data driver 500 so that the data driver 500 may apply a data voltage Vd with a positive level to the corresponding pixel PX during the 1 horizontal period of the third frame, as shown in FIG. 6. In this instance, the signal controller 600 again stores the 1 horizontal period 1H that is newly updated application time information and is generated by subtracting the 1 horizontal period from the 2 horizontal periods previously updated as application time information of the data voltage through the counting of the counter 620 in the corresponding storage space of the third memory 616. Because data voltage with a positive level is applied during the 1 horizontal period of the third frame the electrophoretic particles 31 and 33 disposed in the corresponding pixel PX move as shown in the picture after passing the third frame of FIG. 7 such that the corresponding pixel PX displays the image corresponding to the first gray, as shown in FIG. 8.

After passing the third frame and before the start of the fourth frame, the signal controller 600 again reads the gray information, the level information of the data voltage, and the updated application time information of the data voltage from the first memory 612, the second memory 614, and the third memory 616 when the signal controller 600 does not receive additional gray information from the external graphics controller or the external input device. The 0 gray information 0G that is the same as the previous frame and the level information B of the positive data voltage are respectively stored in the corresponding storage spaces of the first memory 612 and the second memory 614, and the 1 horizontal period time information 1H that is updated application time information of the data voltage is stored in the third memory 616. Accordingly, the signal controller 600 applies an output image signal DAT to the data driver 500 so that the data driver 500 may apply a data voltage Vd with a positive level to the corresponding pixel PX during the 1 horizontal period of the fourth frame. In this instance, the signal controller 600 again stores the 0 horizontal period time information 0H that is newly updated application time information and is generated by subtracting the 1 horizontal period from the 1 horizontal period that is previously updated as application time information of the data voltage through the counting of the counter 620 in the corresponding storage space of the third memory 616. Because data voltage with a positive level is applied during the 1 horizontal period of the fourth frame the electrophoretic particles 31 and 33 disposed in the corresponding pixel PX move as shown in the picture after passing the fourth frame of FIG. 3 such that the corresponding pixel PX displays the image corresponding to the 0 gray which is finally displayed, as shown in FIG. 4.

However, the signal controller 600 may receive new gray information from the external graphics controller or the external input device after the passing of the third frame before the start of the fourth frame.

If the new gray information is input, the signal controller 600 compares the gray information previously stored in the first memory 162 with the new gray information by the synchronization of the horizontal synchronizing signal Hsync. As shown in FIG. 5, because the previous stored gray information is the 0 gray information 0G, and the new gray information is the 3 gray information 3G, the previously stored gray information is different from the new gray information. In this case, the signal controller 600 stores the 3 gray information 3G input as new gray information in the first memory 162. Also, the signal controller 600 stores the level information and the application time information of the data voltage, required to display the image of 3 gray from the 4 frame in the corresponding pixel PX, that is newly updated in the second memory 164 and the third memory 166, respectively.

Here, the level information and the newly updated application time information of the data voltage are level information W and 2 horizontal period time information 2H that must be newly updated to amend the luminance of 1 gray that the corresponding pixel PX now displays into the luminance corresponding to the 3 gray that the corresponding pixel PX will newly display based on the 3 gray information 3G. The luminance of 1 gray is based on the 0 gray information 0G, the level information B of the positive data voltage, and the application time information 1H of the data voltage that is updated, which were previously stored in the first memory 612, the second memory 164, and the third memory 166.

If the storage is completed before the start of the third frame, the signal controller 600 again reads the gray information, the level information of the data voltage, and the application time information of the data voltage, which are respectively stored in the corresponding storage spaces of the first memory 612, the second memory 614, and the third memory 616. The 3 gray information 3G is stored in the storage space of the first memory 612, and the level information W of the negative data voltage and the 2 horizontal period time information 2H as the application time information of the data voltage are respectively stored in the second memory 614 and the third memory 616. Accordingly, the signal controller 600 applies an output image signal DAT to the data driver 500 so that the data driver 500 may apply a data voltage Vd with a negative level to the corresponding pixel PX during the 1 horizontal period of the fourth frame, as shown in FIG. 6. In this instance, the signal controller 600 again stores the 1 horizontal period 1H that is updated application time information and is generated by subtracting the 1 horizontal period from the 2 horizontal periods that is previously updated as application time information of the data voltage through the counting of the counter 620 in the corresponding storage space of the third memory 616.

Because data voltage with a negative level is applied during the 1 horizontal period of the fourth frame the electrophoretic particles 31 and 33 disposed in the corresponding pixel PX move as shown in the picture after passing of the fourth frame of FIG. 7, such that the corresponding pixel PX displays the image corresponding to the second gray, as shown in FIG. 8.

After the passing the fourth frame and before the start of the fifth frame, the signal controller 600 again reads the gray information, the level information of the data voltage, and the updated application time information of the data voltage that are stored in the first memory 612, the second memory 614, and the third memory 616. The 3 gray information 3G that is the same as the previous frame and the level information W of the negative data voltage are respectively stored in the corresponding storage spaces of the first memory 612 and the second memory 614, and the 1 horizontal period time information 1H that is the updated application time information of the data voltage is stored in the corresponding storage space of the third memory 616. Accordingly, the signal controller 600 applies an output image signal DAT to the data driver 500 so that the data driver 500 may apply a data voltage Vd with a negative level to the corresponding pixel PX during the 1 horizontal period of the fifth frame, as shown in FIG. 6. In this instance, the signal controller 600 again stores the 0 horizontal period time information 0H that is newly updated application time information and is generated by subtracting the 1 horizontal period from the 1 horizontal period that is previously updated as application time information of the data voltage through the counting of the counter 620 in the corresponding storage space of the third memory 616. Because data voltage with a negative level is applied during the 1 horizontal period of the fifth frame the electrophoretic particles 31 and 33 disposed in the corresponding pixel PX move as shown in the picture after passing the fifth frame of FIG. 7. Accordingly, the corresponding pixel PX finally displays the image corresponding to the third gray, as shown in FIG. 8.

On the other hand, after passing the fifth frame and before the start of the sixth frame, the signal controller 600 may receive new gray information from the external graphics controller or the external input device.

Therefore, the signal controller 600 compares the gray information previously stored in the first memory 162 with the new gray information by the synchronization of the horizontal synchronizing signal Hsync. As shown in FIG. 5, because the previous stored gray information is the 3 gray information 3G and the new gray information is the 3 gray information 3G, the previously stored gray information is the same as the new gray information. In this case, the signal controller 600 ignores the new input gray information and keeps on driving the data driver 500 based on the gray information, the level information of the data voltage, and the application time information of the data voltage, which are respectively stored in the first memory 162, the second memory 164, and the third memory 166.

In other words, the signal controller 600 again reads the gray information, the level information of the data voltage, and the application time information of the data voltage, which are respectively stored in the first memory 162, the second memory 164, and the third memory 166.

As shown in FIG. 5, the 3 gray information 3G that is the same as the previous frame and the level information W of the negative data voltage are respectively stored in the storage spaces of the first memory 612 and the second memory 614, and the 0 horizontal period time information 0H as the updated application time information stored in the third memory 616. Accordingly, the corresponding third memory 616 no longer needs the updating through the counting. Therefore, the signal controller 600 applies the corresponding output image signal DAT to the data driver 500 such that the data driver 500 does not apply the data voltage with a negative level to the corresponding pixel PX during the 1 horizontal period of the sixth frame. Accordingly, the electrophoretic particles 31 and 33 disposed in the corresponding pixel PX are maintained with the arrangement as shown in the picture after the passing of the sixth frame of FIG. 7. Accordingly, the corresponding pixel PX continuously displays the image corresponding to the 3 gray, as shown in FIG. 8.

On the other hand, when the application time information of the data voltage stored in the storage space of the third memory 616 is not 0 horizontal period time information 0H, the signal controller 600 applies the corresponding output image signal DAT to the data driver 500 and again stores the application time information that is updated through the counting of the counter 620 in the third memory 616 such that the data driver 500 applies the data voltage with a negative level to the corresponding pixel PX during 1 horizontal period of the sixth frame.

In this manner, all pixels PX may rapidly display the images of the desired grays through the real-time necessary update per frame.

After displaying the desired images on all pixels PX, the signal controller 600 may apply an output image compensation signal to the data driver 400 to remove the stimulated charges to the pixel electrode 190 and the common electrode 270 of the corresponding pixels PX.

For this to occur, the signal controller 600 first reads the gray information, the level information of the data voltage, and the application time information of the data voltage, which are respectively stored in the first memory 612, the second memory 614, and the third memory 616. As shown in FIG. 5, after the passing of the 6 frame, the 3 gray information 3G, the level information W of the negative data voltage, and the 0 horizontal period time information 0H as the updated application time information are respectively and finally stored in the storage spaces of the first memory 612, the second memory 614, and the third memory 616.

The signal controller 600 again stores the necessary respective compensation information to the first memory 162, the second memory 164, and the third memory 166 based on the storage information from the memory 610 to remove the stimulated charges on the pixel electrode 190 and the common electrode 270 in the process for finally displaying the 3 gray image in the corresponding pixel PX. Here, the compensation information is information required for the corresponding pixel PX to again display the image to 4 gray from 3 gray, to match the value that the data voltage applied with the predetermined magnitude in the process of displaying the predetermined image is integrated with the application time with the value that the data voltage applied with the predetermined magnitude for an image display compensation is integrated with the corresponding application time. In the compensation information calculated by the above condition, the gray information is 4 gray information, the level information of the data voltage is level information W of the negative data voltage, and the application time of the data voltage is 1 horizontal period 1H.

If the storage of the compensation information is completed, the signal controller 600 reads the gray information, the level information of the data voltage, and the application time information of the data voltage respectively stored in the corresponding space of the first memory 612, the second memory 614, and the third memory 616, and applies the data voltage with a negative level during 1 horizontal period. Accordingly, the corresponding pixel PX displays the image corresponding to 4 gray of FIG. 4 such that the charge compensation is completed.

As described above, in the driving apparatus and driving method of the electrophoretic display according to an exemplary embodiment, in repeating the above-described driving process the required data voltage may be applied to each pixel by updating the gray information from the outside in real-time such that the desired image may be rapidly displayed, thereby improving the display speed of the image of the electrophoretic display.

Figure 9:
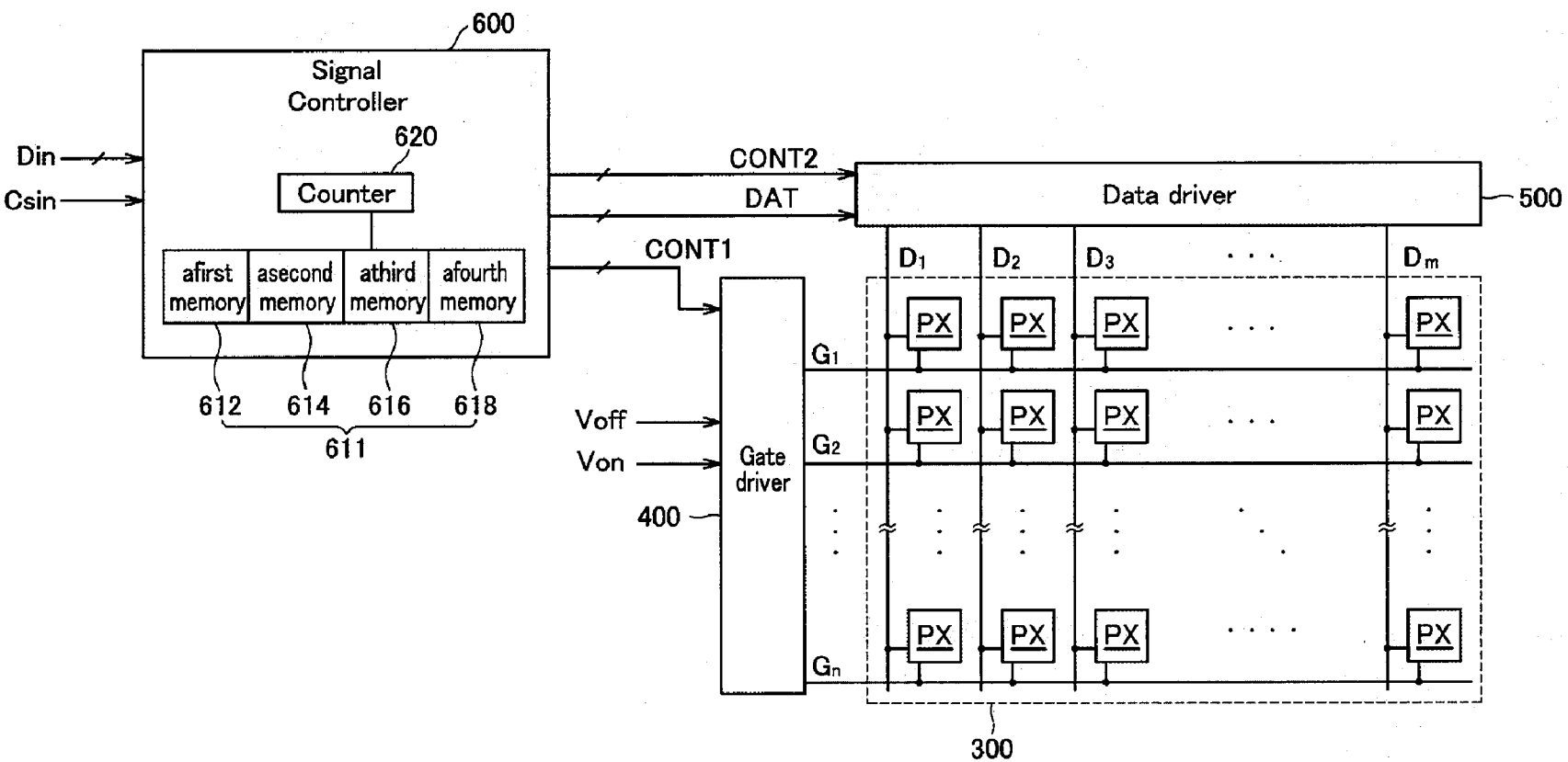
FIG. 9 is a block diagram of an electrophoretic display according to another exemplary embodiment.

Hereafter, a driving apparatus and driving method of an electrophoretic display according to another exemplary embodiment will be described with reference to FIG. 9, compared to the driving apparatus and the driving method electrophoretic display shown in FIG. 1 according to an exemplary embodiment.

FIG. 9 is a block diagram of an electrophoretic display according to another exemplary embodiment.

An apparatus for driving an electrophoretic display shown in FIG. 9 further includes a fourth memory 618 to store position information of each pixel to which a data voltage is applied in a memory unit 611, differently from the electrophoretic display of FIG. 1.

In the method for driving the electrophoretic display of FIG. 9, although the signal controller 600 has additional frame information, the position information of each pixel PX may be directly obtained. Accordingly, the gray information stored in the first memory 612 corresponding to each pixel PX may be directly compared with the gray information that is newly input.

As described above, according to the driving apparatus and the driving method of the electrophoretic display according to an exemplary embodiment, the required data voltage may be directly applied to each pixel by updating the gray information from the outside in real-time such that the desired image may be rapidly displayed, thereby improving the display speed of the image of the electrophoretic display.

While the disclosure has been described in connection with what is presently considered to be practical exemplary embodiments, it is to be understood that the subject matter is not limited to the disclosed embodiments, but, on the contrary, is intended to cover various modifications and equivalent arrangements included within the spirit and scope of the appended claims.

What is claimed is:

1. An apparatus for driving an electrophoretic display comprising:

a data driver configured to apply data voltages to a plurality of pixels where electrophoretic particles are respectively disposed;

a memory configured to store gray information, level information of data voltages, and application time information of the data voltage; and a signal controller configured to read the gray information, the level information of the data voltage, and the application time information of the data voltage stored in the memory, and configured to output an output image signal to the data driver, wherein the signal controller is further configured to perform counting to update the application time information of the data voltage, the counting being performed by synchronization of a data enable signal;

wherein the signal controller is further configured to store the updated application time information of the data voltage in the memory after the counting, to compare the gray information stored in the memory with updated gray information input from an external device, to store an updated level information of the data voltage and a further updated application time information in the memory, where the updated level information and the further updated application time information are determined based on the gray information stored in the memory and the updated gray information when the gray information stored in the memory and the updated gray information are different from each other.

2. The apparatus of claim 1, wherein the memory comprises:

a first memory configured to store the gray information;

a second memory configured to store the level information of the data voltage; and a third memory configured to store the application time information of the data voltage.

3. The apparatus of claim 2, wherein the signal controller is configured to read the gray information, the level information of the data voltage, and the application time information of the data voltage stored in the first memory, the second memory, and the third memory to output the output image signal to the data driver; to store the updated application time information of the data voltage in the third memory where the updated application time information is determined by counting the application time information of the data voltage; to compare the gray information stored in the first memory with the updated gray information that is input from the external device; and when the gray information stored in the first memory and the updated gray information are different from each other, to store values of the level information of the data voltage and the application time information of the data voltage that are used to change the luminance currently displayed by the pixel into the luminance corresponding to the updated gray information.

4. The apparatus of claim 3, wherein the signal controller is configured to compare the gray information stored in the first memory with the updated gray information; and when the gray information stored in the first memory and the updated gray information are the same, to ignore the updated gray information and continue driving the data driver based on the gray information, the level information of the data voltage, and the application time information of the data voltage respectively stored in the first memory, the second memory, and the third memory.

5. The apparatus of claim 4, wherein the signal controller is configured to perform the counting via a counter that is included as a predetermined time unit.

6. The apparatus of claim 5, wherein the counting is performed per 1 frame.

7. The apparatus of claim 6, wherein the data voltage is applied during 1 horizontal period per the 1 frame, and the application time information of the data voltage updated through the counting is the application time information that is generated by subtracting 1 horizontal period from the application time of the data voltage before performing the counting.

8. The apparatus of claim 7, wherein the comparison of the gray information stored in the first memory with the updated gray information input from the external device is performed by synchronization of a horizontal synchronizing signal.

9. The apparatus of claim 2, wherein the signal controller is configured to output an output image compensation signal to the data driver based on the gray information, the level information of the data voltage, and the application time information of the data voltage stored in the memory after the application time information of the data voltage stored in the memory is updated.

10. The apparatus of claim 2, wherein the storage space of the memory corresponds one to one to the pixels.

11. The apparatus of claim 2, wherein the memory further includes a fourth memory storing position information of each pixel to which the data voltage is applied.

12. A method for driving an electrophoretic display comprising:

storing gray information, level information of the data voltage, and application time information of the data voltage in a memory;

outputting an output image signal to a data driver based on the gray information, the level information of the data voltage, and the application time information of the data voltage stored in the memory, and again storing updated application time information of the data voltage by counting the application time information of the data voltage in the memory, wherein the counting is performed by the synchronization of a data enable signal; and comparing the gray information stored in the memory with new gray information input from an external device, and when the gray information stored in the memory is different from the new gray information, storing updated level information of the data voltage and updated application time information of the data voltage determined based on the new gray information, and when the gray information stored in the memory is the same as the new gray information, ignoring the new gray information and continuing to drive the data driver based on the gray information, the level information of the data voltage, and the application time information of the data voltage stored in the memory.

13. The method of claim 12, wherein the memory includes:

a first memory storing the gray information;

a second memory storing the level information of the data voltage; and a third memory storing the application time information of the data voltage.

14. The method of claim 13, wherein the outputting further includes:

reading the gray information, the level information of the data voltage, and the application time information of the data voltage respectively stored in the first memory, the second memory, and the third memory to output the output image signal to the data driver, and storing updated application time information of the data voltage in the third memory by counting the application time information of the data voltage.

15. The method of claim 14, wherein the comparing, and the storing updated level information further include:

comparing the gray information stored in the first memory with the new gray information, and when the gray information stored in the first memory and the new gray information are different from each other, storing revised values of the level information of the data voltage and the application time information of the data voltage that are used to change the luminance displayed in the pixel based on the gray information stored in the first memory into the luminance corresponding to the newly gray information.

16. The method of claim 15, wherein when the revised values of the level information of the data voltage and the application time information of the data voltage are stored in the second memory and the third memory, the method further includes:

outputting the output image signal to the data driver according to the gray information, the level information of the data voltage, and the application time information of the data voltage again stored in the first memory, the second memory, and the third memory respectively, and storing the application time information updated through the counting in the third memory.

17. The of method claim 12, further comprising:

applying an output image compensation signal to the data driver after the application time information of the data voltage stored in the memory is updated through the counting.

18. The method of claim 12, wherein the counting is performed per 1 frame.

19. The method of claim 18, wherein the data voltage is applied during 1 horizontal period per the 1 frame, and the application time information of the data voltage updated through the counting is the application time information generated by subtracting 1 horizontal period from the application time of the data voltage before performing the counting.

20. The method of claim 19, wherein the comparison of the gray information stored in the first memory with the new gray information is performed by the synchronization of a horizontal synchronizing signal.

21. The method of claim 13, further comprising:

outputting an output image compensation signal to the data driver based on the gray information, the level information of the data voltage, and the application time information of the data voltage stored in the memory, after the application time information of the data voltage stored in the memory is updated.

22. The method of claim 13, wherein the memory further includes a fourth memory storing position information of each pixel to which the data voltage is applied.

* * * * *